US009378713B1

(12) United States Patent
Smith

(10) Patent No.: US 9,378,713 B1
(45) Date of Patent: Jun. 28, 2016

(54) QUICK RELEASE ADJUSTABLE BASS DRUM BEATER ASSEMBLY

(71) Applicant: Kevin Daniel Smith, Indio, CA (US)

(72) Inventor: Kevin Daniel Smith, Indio, CA (US)

(73) Assignee: Kevin Daniel Smith, Indio, CA (US)

( * ) Notice: Subject to any disclaimer, the term of this patent is extended or adjusted under 35 U.S.C. 154(b) by 0 days.

(21) Appl. No.: 14/544,347

(22) Filed: Dec. 29, 2014

Related U.S. Application Data

(60) Provisional application No. 61/964,998, filed on Jan. 22, 2014.

(51) Int. Cl.
*G10D 13/02* (2006.01)
*G10D 13/00* (2006.01)

(52) U.S. Cl.
CPC ..... *G10D 13/006* (2013.01)

(58) Field of Classification Search
CPC ..... G10D 13/006
See application file for complete search history.

(56) References Cited

U.S. PATENT DOCUMENTS 1,445,650 A * 2/1923 Strupe ..... G10D 13/006 84/422.2
3,316,792 A * 5/1967 Ippolito ..... G10D 13/006 84/422.1
5,610,351 A * 3/1997 Yanagisawa ..... G10D 13/006 84/422.1
5,763,798 A * 6/1998 Chen ..... G10D 13/003 84/422.1
5,998,718 A * 12/1999 Liao ..... G10D 13/006 84/422.1
7,211,720 B1 * 5/2007 Dorfman ..... G10D 13/006 84/422.1
7,663,041 B1 * 2/2010 Lin ..... G10D 13/006 84/422.1
7,671,262 B1 * 3/2010 Lin ..... G10D 13/006 84/422.1
7,812,237 B1 * 10/2010 Dunnett ..... G10D 13/006 84/422.1
7,855,331 B1 * 12/2010 Chen ..... G10D 13/006 84/422.1
7,858,861 B1 * 12/2010 Chen ..... G10D 13/006 84/422.1
7,999,165 B2 * 8/2011 Chen ..... G10D 13/006 84/422.1
8,212,133 B2 * 7/2012 Chen ..... G10D 13/006 84/422.1
8,262,542 B2 * 9/2012 Pinamonte ..... G10D 13/006 482/51
8,624,097 B1 * 1/2014 Liao ..... G10D 13/006 84/422.1
2003/0094088 A1 * 5/2003 Kjellgren ..... G10D 13/006 84/422.1

* cited by examiner

*Primary Examiner* — Robert W Horn
(74) *Attorney, Agent, or Firm* — Jack C. Munro

(57) ABSTRACT

A bass drum beater assembly which is to strike a bass drum face by actuation of a foot pedal. The bass drum beater assembly is capable of being quickly turned one hundred and eighty degrees to cause the back side of the beater head to strike the bass drum face rather than the front side. The bass drum beater assembly is also quickly axially adjustable to vary the striking position on the bass drum face.

15 Claims, 9 Drawing Sheets locked unlocked

QUICK RELEASE ADJUSTABLE BASS DRUM BEATER ASSEMBLY

BACKGROUND OF THE INVENTION

1. Field of the Invention

This invention is in the field of musical instruments and more particularly to a novel foot actuated mechanism for beating a bass drum.

2. Description of the Prior Art

A foot actuated bass drum pedal assembly is commonly used by percussionists to strike a bass drum musical instrument. Bass drums are available in different diameters causing the target area on the face of the drum to be located different distances from its supporting surface. This variability in distance, because of the different diameters of drums, makes it necessary to be able to adjust the length of the bass drum beater head mounted to the bass drum pedal assembly. For best sound production the beater head should strike the drum at a preferred location.

Percussionists also like to adjust the sounds created by the bass drum beater head by striking the bass drum face in different locations. This makes it necessary to be able to adjust the position of the bass drum beater head within the bass drum pedal assembly in order to strike the drum face at different locations on the drum face.

Percussionists also like to adjust the speed of the swinging bass drum beater head within the bass drum pedal assembly. Adjusting the length that the beater head extends from the pedal assembly causes the speed or tempo of the produced sound to change.

Also bass drum faces wear in the area being struck by the bass drum beater head. Constantly beating the drum face in the same location can cause premature failure of the tightly stretched membrane that constitutes the drum face. This premature failure can be avoided by changing striking locations. Adjusting the beater head up or down to strike at a different area of the bass drum face allows the percussionist to obtain more usage out of the drum face before requiring replacement of the membrane.

Also bass drum beater heads can have multiple contact surfaces where the different surfaces are constructed with different materials or have different configurations each of which create a different sound as the beater head strikes the drum face. In the prior art if the back side of the beater head was desired to be used instead of the front side, the drummer had to loosen a set screw, remove the beater head, turn it around and reinstall it. This is time consuming and cannot be accomplished when playing a song. Further to use a different beater head makes it necessary to also remove one beater head from the drum pedal and install another beater head into the pedal assembly. This replacement of beater heads in the prior art requires again loosening a set screw, which permits the installed beater head to be removed and a different beater head installed. Loosening of the set screw requires a tool called a "key". The drummer will need both hands to loosen the set screw with the key, remove the installed beater head and then place the different beater head in position and reinstall the set screw. This change of beater heads is time consuming and cannot be performed while the drummer is performing. At times a drummer would like to change a beater head between performing songs.

SUMMARY OF THE INVENTION

The adjustable bass drum beater assembly of this invention allows for quick and easy one handed adjustment of the bass drum beaters head position without the need to loosen the set screw holding the beater head to the pedal assembly. The adjustable bass drum beater assembly of this invention allows for quick and easy one handed removal and installation of a beater head. This quick and easy adjustment and installation of a beater head makes it possible to adjust or replace the beater head during playing of a song or between songs. Currently the time involved in changing a beater head makes this unreasonable and is rarely attempted.

DETAILED DESCRIPTION OF THE INVENTION

Figure 1:
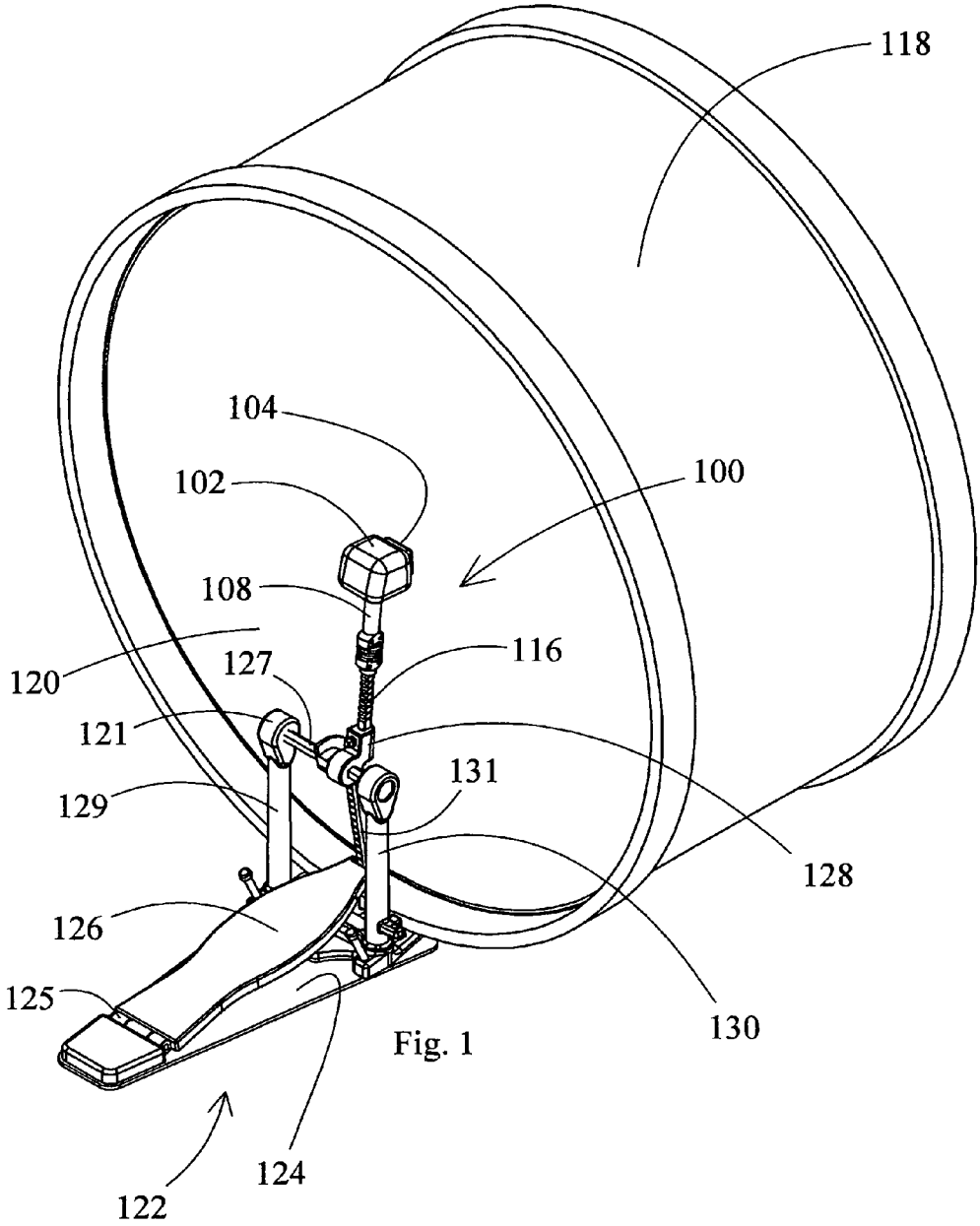
FIG. 1 is an isometric view of a prior art bass drum pedal assembly which includes the adjustable bass drum beater assembly of this invention showing such in the striking position.

Referring particularly to FIG. 1 there is shown a typical bass drum 118 which has a drum face 120. Associated with the bass drum 118 is a foot operated pedal assembly 122. Pedal assembly 122 includes a base plate 124 to which is hingedly connected by hinge 125 to the back edge of a foot pedal 126. Fixedly mounted on base plate 124 are a pair of spaced apart, parallel, upright stanchions 129 and 130. A journal 121 is fixedly mounted to the upper free end of stanchion 129. A journal 123 is fixedly mounted to the upper free end of stanchion 130. Connected between the journals 121 and 123 is a shaft 127. Shaft 127 is capable of pivoting relative to journals 121 and 123.

Figure 2:
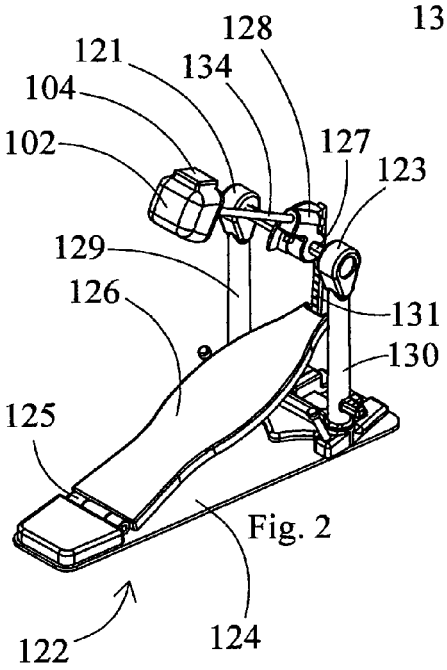
FIG. 2 is an isometric view of a prior art bass drum pedal assembly that is commonly used to strike a drum face showing a prior art beater head in the at rest or cocked position.
Figure 4:
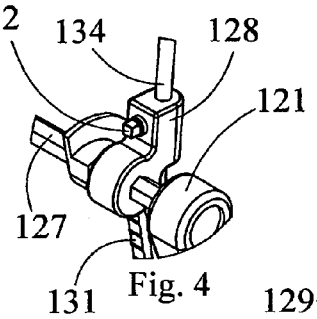
FIG. 4 is an enlarged isometric view of a portion of the prior art bass drum pedal assembly taken along encircled line 4 in FIG. 3 where the beater head is in the at rest position.
Figure 3:
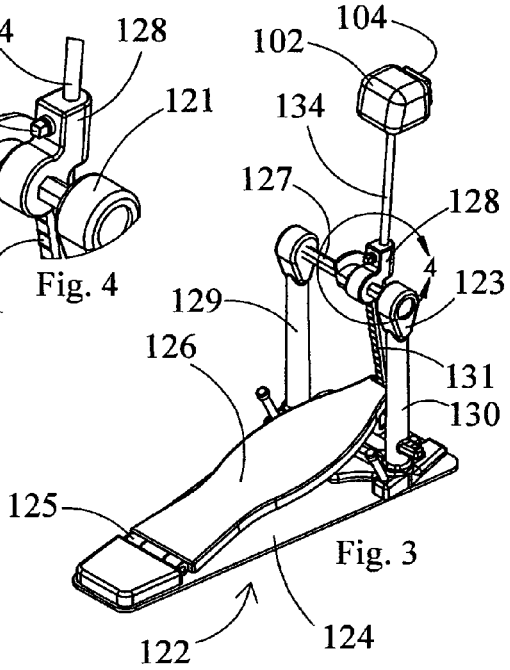
FIG. 3 is an isometric view of a bass drum pedal assembly with a prior art bass drum beater head in the striking position.
Figure 5:
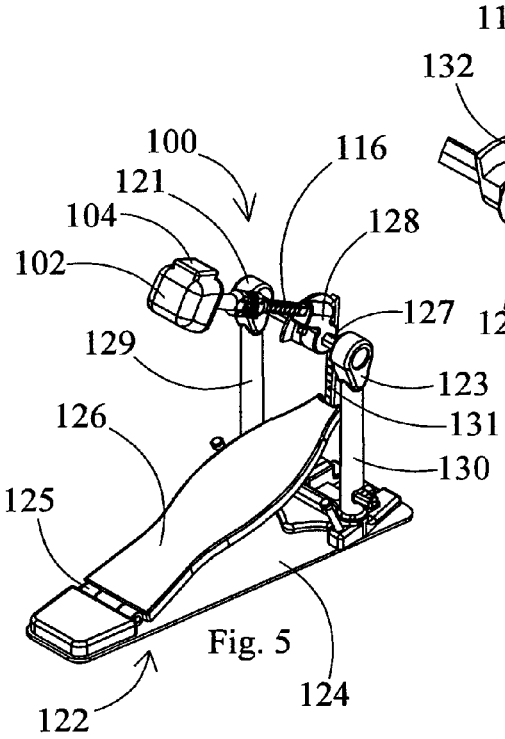
FIG. 5 is an isometric view of the pedal assembly with the beater assembly of this invention in the at rest or cocked position.
Figure 7:
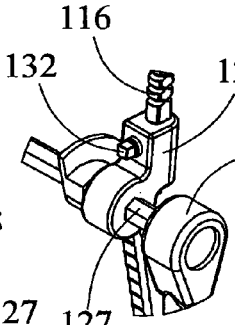
FIG. 7 is an enlarged isometric view of a portion of the beater assembly of this invention taken along encircled line 7 of FIG. 6.
Figure 6:
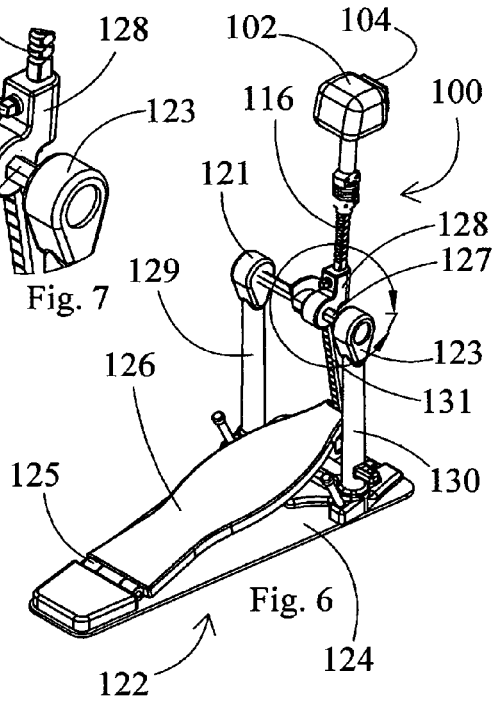
FIG. 6 is an isometric view of the adjustable bass drum beater assembly of this invention showing same in the striking position.
Figure 8:
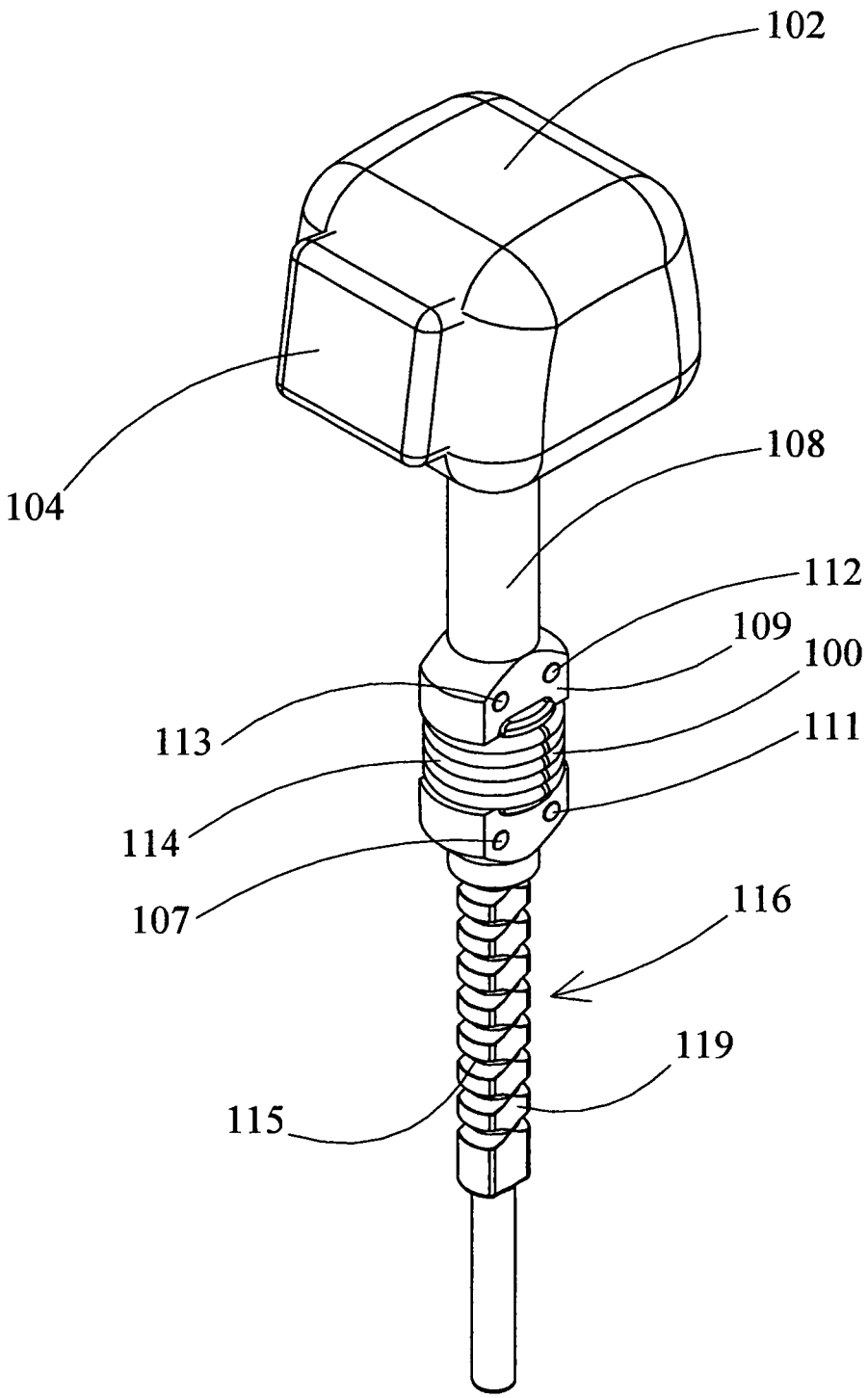
FIG. 8 is an isometric view of the beater assembly of this invention showing the beater assembly in the locked position.
Figure 9:
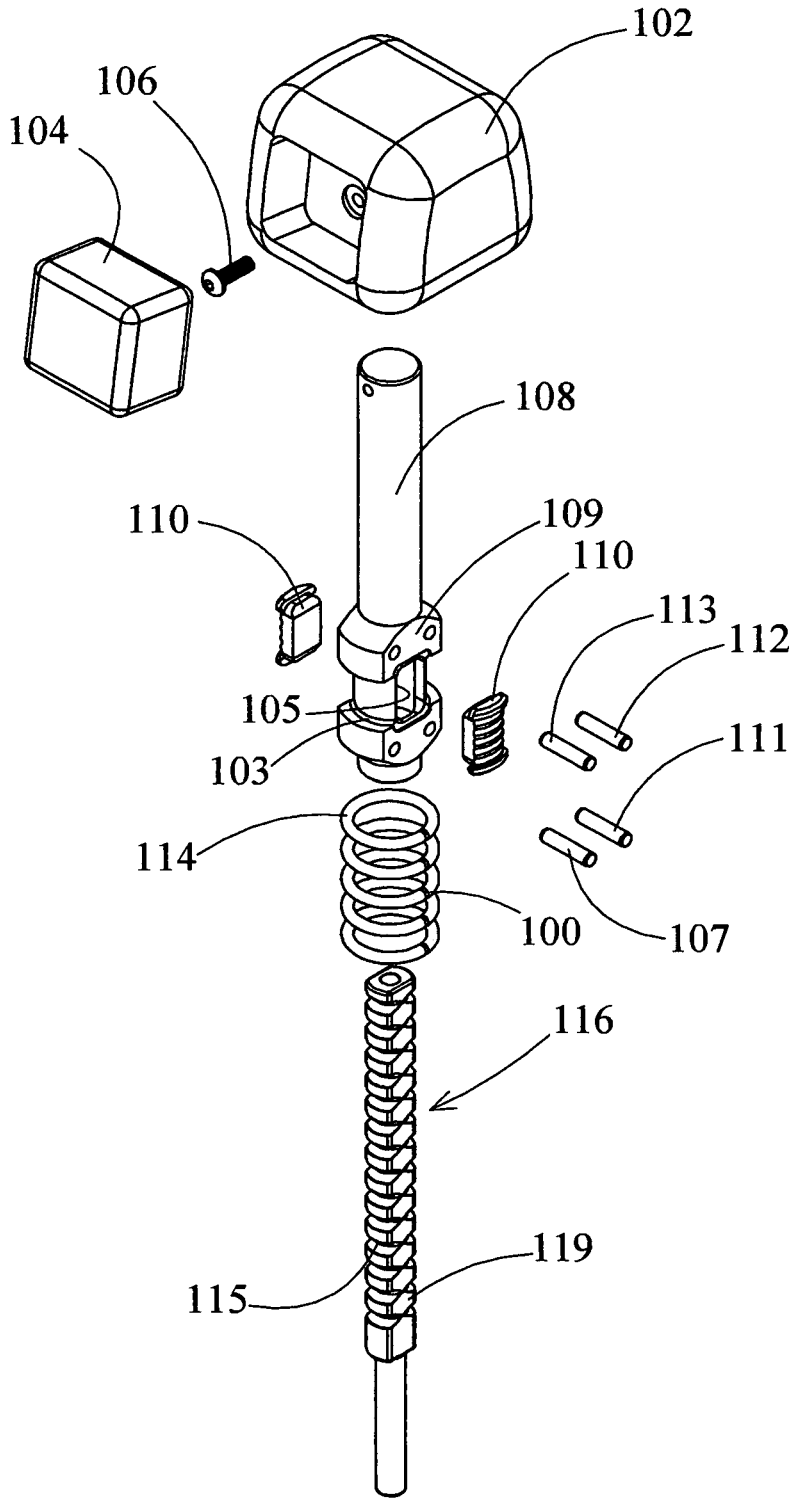
FIG. 9 is an exploded isometric view of the beater assembly of this invention showing more clearly the different parts of the beater assembly.
Figure 10:
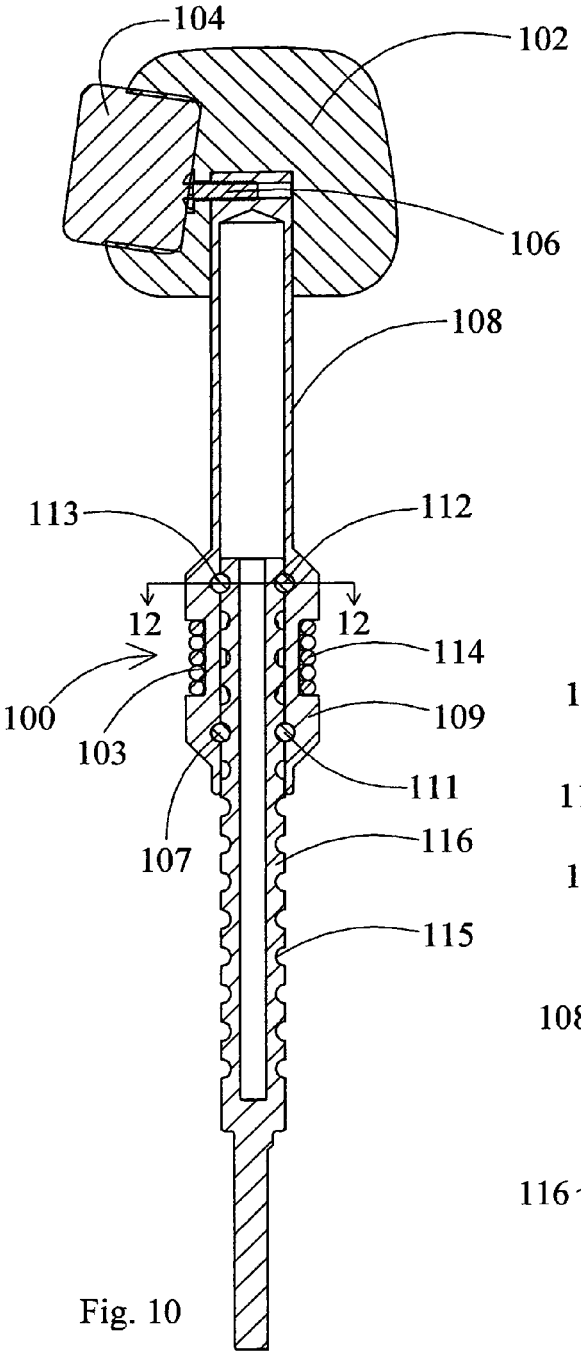
FIG. 10 is a cross-sectional view of the beater assembly of this invention showing such in the extended locked position.
Figure 11:
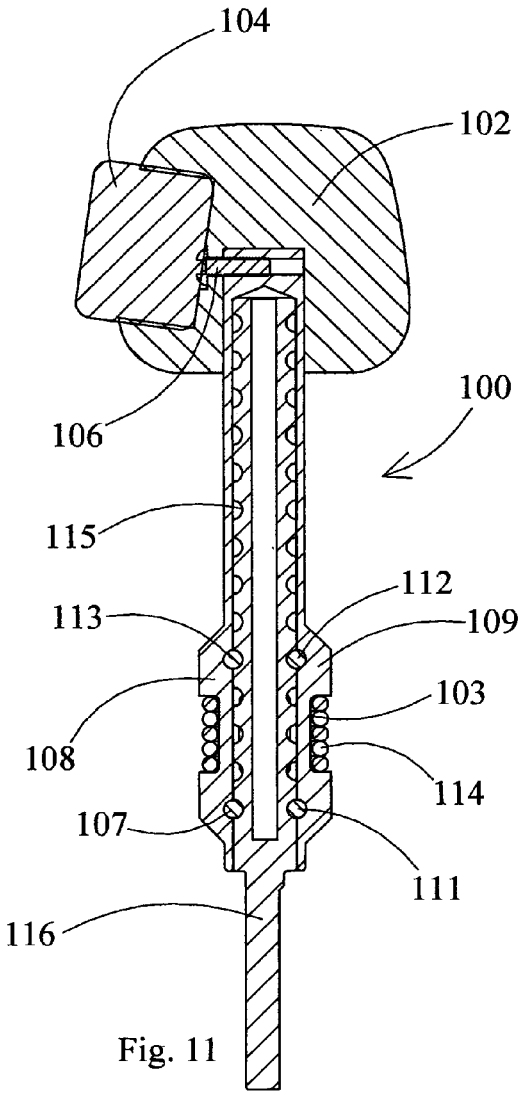
FIG. 11 is a view similar to FIG. 10 showing the beater assembly in the non-extended locked position.

Mounted on shaft 127 is a connector. A connecting member such as a chain 131 connects between foot pedal 126 and connector 128. Connector 128 can pivot relative to chain 131. Chain 131 is attached to the front edge of foot pedal 126. Pushing down on foot pedal 126 causes connector 128 to pivot with the maximum amount of movement being about seventy five degrees when comparing FIG. 3 with FIG. 2. The at rest position of foot pedal 126 is in its upper position shown in FIG. 2. FIGS. 2, 3 and 4 are directed to prior art structure where a mounting shaft 134 is secured to connector 128 by placing shaft 134 in a hole in connector 128 and then set screw 132 is tightened. Attached to the outer end of shaft 134 is a beater head 102. Beater head 102 can assume any conventional configuration such as the solid block shown. Beater head 102 can also include a felt block 104 which is mounted on one side of block 102 by a screw 106. In the prior art the block of head 102 can face the drum face 120 or the set screw 132 can be loosened and the shaft 134 turned one hundred and eighty degrees to have the felt block 104 face the drum face 120. Then set screw 132 is tightened fixing the shaft 134 to connector 128. The felt block 104 produces a muted sound and the solid block of head 102 produces a sharper unmuted sound.

The structure of this invention is as follows: A mounting shaft 116 replaces shaft 134 and is tightly secured to connector 128 by set screw 132. Mounting shaft 116 has opposite flattened sides 117 and 119. Mounting shaft 116 also has a plurality of grooves 115 with fourteen in number of grooves 115 being shown. The number of grooves 115 can be increased or decreased. Telescopingly mounted on mounting shaft 116 is a slide shaft 108. Slide shaft 108 has a block 109 fixedly mounted thereon. Mounted in block 109 are a pair of pins 112 and 113. Also mounted in block 109 and axially spaced from pins 112 and 113 are another pair of pins 107 and 111. If block 109 is placed in one rotational position relative to mounting shaft 116, pins 107, 111, 112 and 113 will each rest within a groove 115 locking axially the slide shaft 108 to mounting shaft 116. Depending on what grooves 115 the pins 107, 111, 112 and 113 are located in the beater head 102 can be located closer to foot pedal 126 or farther away which means the beater head 102 will strike the drum face 120 in different positions. Because there are fourteen different grooves 115 there are fourteen different spacings.

To locate the beater head 102 in different axial locations, the drummer pivots the beater head until the pins 107 and 113 contact one of the flattened sides 117 or 119 and the other pins 111 and 112 are in contact with the other flattened side. The drummer can then move the beater head 102, slide shaft 108 and block 109 axially and when the desired axial location is achieved, the drummer manually turns the beater head 102 ninety degrees which will engage the pins 107 and 111 with one groove 115 and pins 112 and 113 with another groove 115. The reason four in number of pins are used is to achieve a positive tight locking action. Only one (or two) pin could be used but the locking might be "sloppy".

Figure 13:
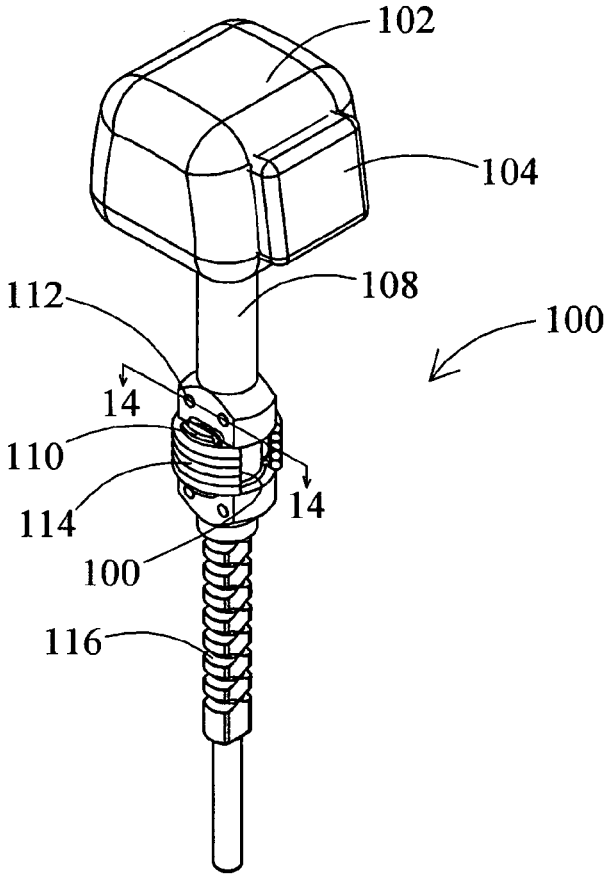
FIG. 13 is an isometric view of the beater assembly of this invention in the unlocked position.
Figure 12:
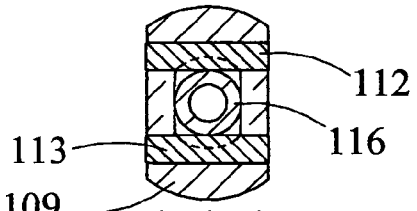
FIG. 12 is a cross-sectional view of the locking pins and fixed shaft in the locked position taken along line 12-12 of FIG. 10.
Figure 14:
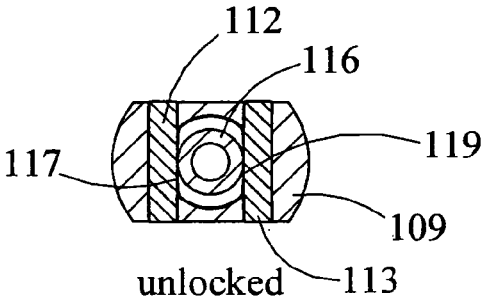
FIG. 14 is a cross-sectional view of the locking pins and fixed shaft in the unlocked position taken along line 14-14 of FIG. 13.
Figure 15:
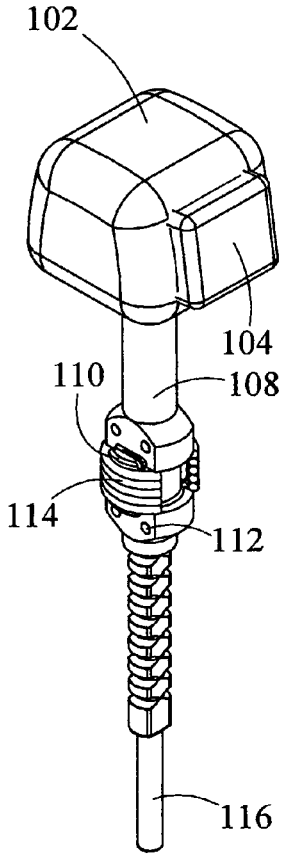
FIG. 15 is an isometric view of the adjustable bass drum beater of this invention showing the assembly in the unlocked position.
Figure 16:
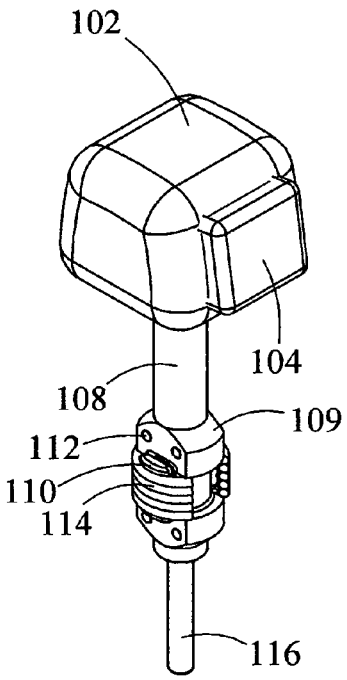
FIG. 16 is an isometric view of the adjustable bass drum beater assembly in the non-extended position.
Figure 17:
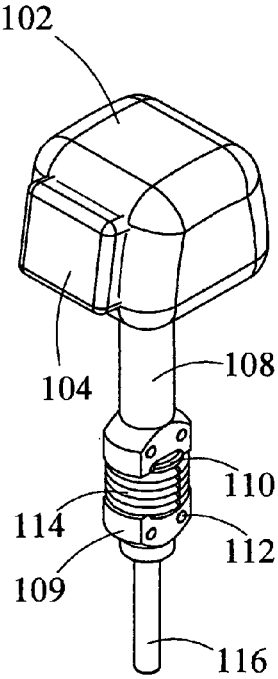
FIG. 17 is an isometric view of the beater assembly of this invention in the non-extended and locked position.
Figure 18:
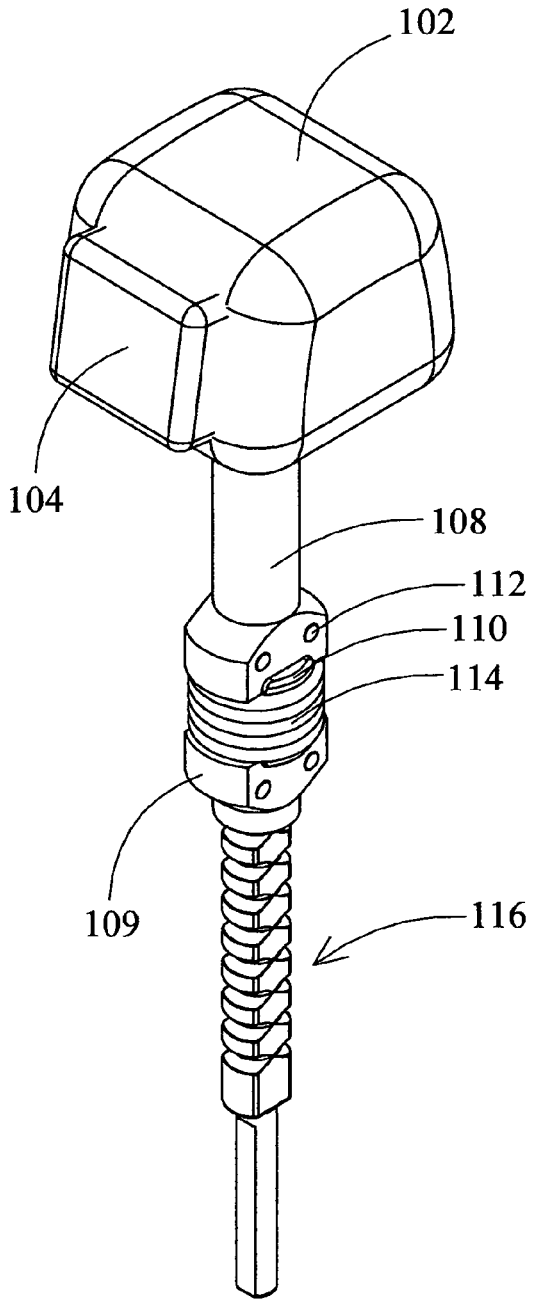
FIG. 18 is an isometric view of the adjustable bass drum beater identical to FIG. 8 where the beater head is in a first position.
Figure 19:
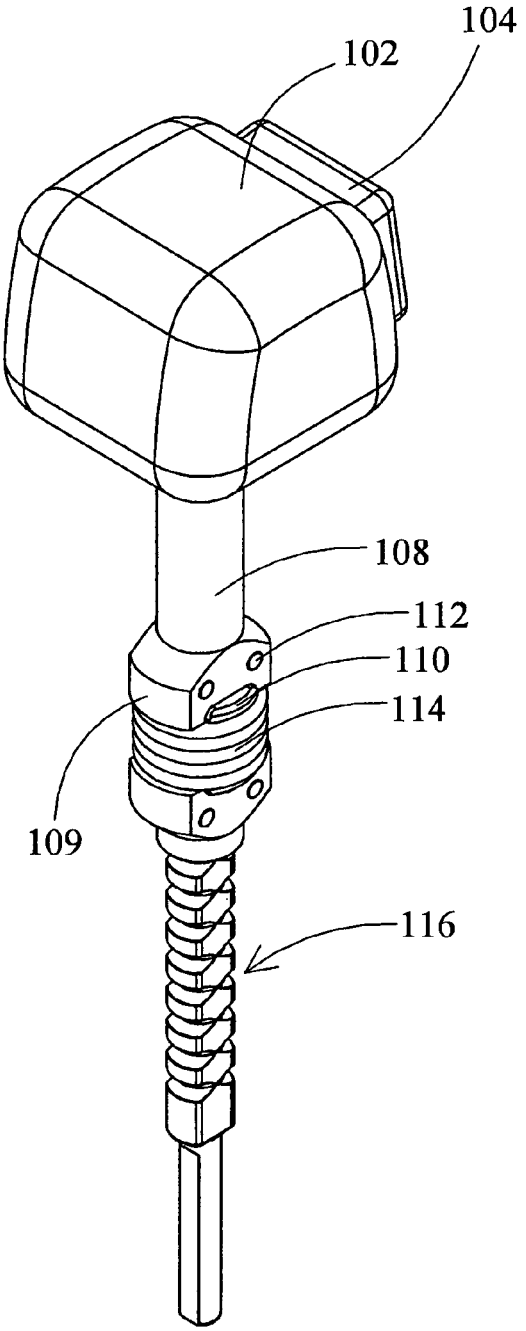
FIG. 19 is an isometric view of the beater assembly where the beater head is turned one-hundred and eighty degrees from the position shown in FIG. 18 and is now in a second position.

Block 109 includes a pair of cut-outs 105 located one hundred and eighty degrees apart. Mounted in each cut-out 105 is a brake plate 110. Contacting the brake plates 110 is a coil spring 114 which rests within annular groove 103. Coil spring 114 exerts a continuous force on brake plates 110 tending to locate such inward. When the brake plates 110 press against the flattened sides 117 and 119, the beater head 102 faces the drum face 120 and the beater head 102 is locked in position by the brake plates 110 pressing on the mounting shaft 116 hence exerting a braking action. The drummer can manually turn beater head 102, unlocking same, one hundred and eighty degrees to locate felt block 104 adjacent the drum face 120. In making this turning the guide plates 110 will move outwardly against the coil spring 114 to permit the brake plates 110 to ride over the non-flattened sections of the mounting shaft 116. This outward movement is permitted by the coil spring 114 including an axial break 100 which can be forcibly expanded from an at rest narrow gap position to a wider gap position. The expansion of the break 100 is shown in FIG. 13.

Figure 20:
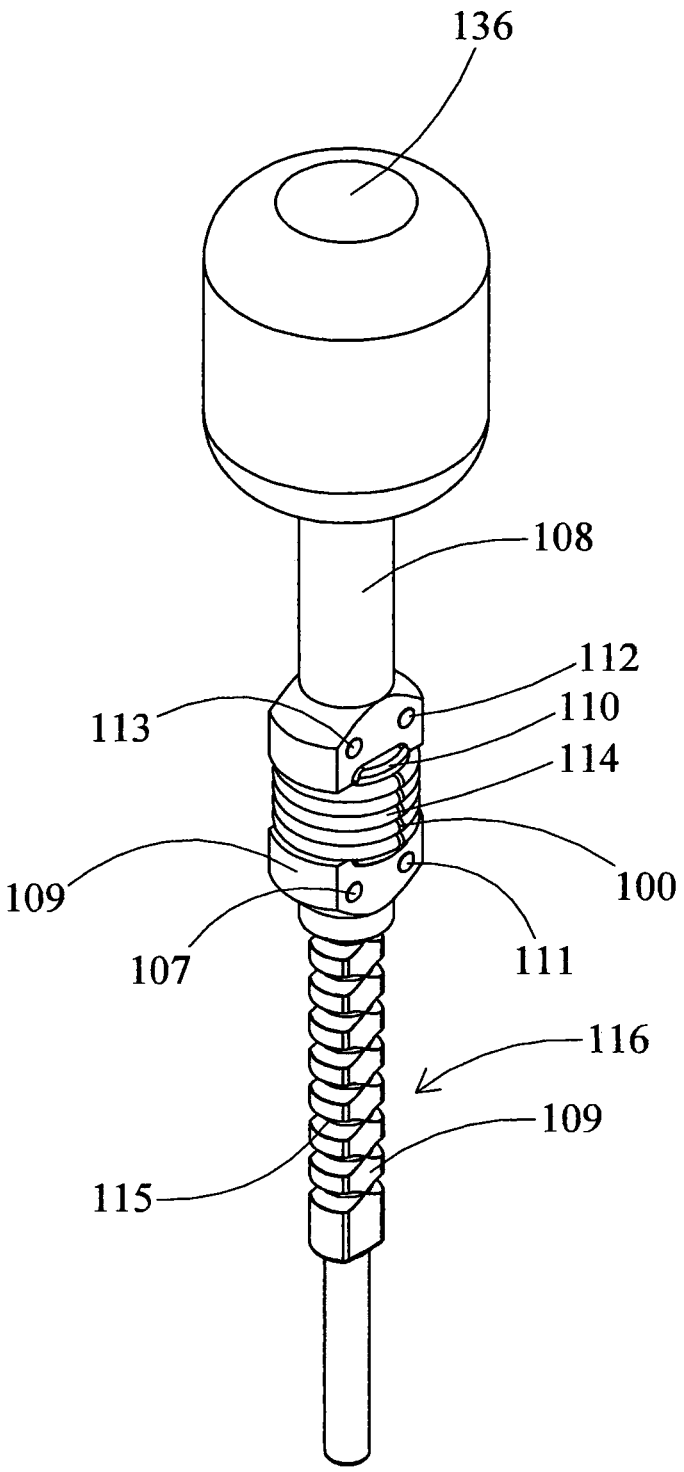
FIG. 20 is an isometric view similar to FIG. 8 where the beater head is of a different configuration.

FIG. 20 shows a different configuration of beater head 136 which is a cylinder.

The main advantage of the present invention is that the beater heads 102 and 136 as well as other configurations can be quickly interchanged even while the drummer is playing. This quick interchangeability was not possible in the prior art.

The invention claimed is:

1. A bass drum beater assembly comprising:

a foot operated pedal having a back edge which is hingedly connected to a base plate and a front edge which is connected to a connecting member;

a connector is attached to said connecting member, pivotal movement of said pedal causes said connector to pivot and when there is a beater head attached to said connector said beater head can strike a bass drum face;

said beater head being secured to a block, said block telescopingly connecting with a mounting shaft, said mounting shaft being connected to said connector with relative movement there between being permitted; and a pin assembly connecting with said connector, said mounting shaft having a pair of flattened sides and a series of grooves, said connector can be pivoted relative to said mounting shaft so said pin assembly could lockingly engage with said grooves axially fixing in position said beater head or said pin assembly could connect with said flattened sides permitting axial movement of said connector relative to said mounting shaft in order to change location with different grooves.

2. The bass drum beater assembly as defined in claim 1 wherein:

said grooves being evenly spaced apart.

3. The bass drum beater assembly as defined in claim 1 wherein:

said pin assembly comprising a plurality of pins.

4. The bass drum beater assembly as defined in claim 1 wherein:

said beater head being mounted on a slide shaft, said slide shaft being secured to said connector, said slide shaft also being telescopingly connected to said mounting shaft with a portion of said mounting shaft sliding within said slide shaft.

5. The bass drum beater assembly as defined in claim 1 wherein:

a brake plate movably mounted on said block, a spring is located on said block flush against said brake plate, said spring exerting a force against said brake plate to tightly locate said brake plate against said mounting shaft.

6. The bass drum beater assembly as defined in claim 5 wherein:

the force of said spring can be overcome by manually turning of said beater head to assume a one hundred and eighty degree different position.

7. The bass drum beater assembly as defined in claim 6 wherein:

said spring comprising a leaf spring.

8. The bass drum beater assembly as defined in claim 7 wherein:

said grooves being evenly spaced apart.

9. The bass drum beater assembly as defined in claim 7 wherein:

said pin assembly comprises a plurality of pins.

10. The bass drum beater assembly as defined in claim 7 wherein:

said beater head being mounted on a slide shaft, said slide shaft being secured to said connector, said slide shaft being secured to said connector, said slide shaft also being telescopingly connected to said mounting shaft with a portion of said mounting shaft sliding within said slide shaft.

11. A quick interchangeable and adjustable bass drum beater assembly comprising:

a foot pedal;

a connector connected to said foot pedal;

a beater head adapted to strike a bass drum face, said beater head being pivotally and axially adjustable on a mounting shaft, said mounting shaft connected to said connector, whereby the axially adjustable feature permits quick interchangeability with another configuration of beater head, whereby the pivotally adjustable feature permits turning around said beater head so the back side of the beater head will strike the bass drum face instead of the front side.

12. A quick interchangeable and adjustable bass drum beater assembly comprising:

a foot pedal;

a connector connected to said foot pedal;

a beater head adapted to strike a bass drum face, said beater head being pivotally and axially adjustable on a mounting shaft, said mounting shaft connected to said connector, whereby the axially adjustable feature permits quick interchangeability with another configuration of beater head, whereby the pivotally adjustable feature permits turning around said beater head so the back side of the beater head will strike the bass drum face instead of the front side;

A quick interchangeable and adjustable bass drum beater assembly as defined in claim 11 wherein:

said axially adjustable feature is achieved by a series of grooves formed in said mounting shaft and at least one pin that is capable of resting within a single groove of said grooves locking said beater head to said mounting shaft, said pin also being disengageable from said single groove to permit said beater head to be moved axially and said pin to then connect with another said single groove.

13. A quick interchangeable and adjustable bass drum beater assembly as defined in claim 11 wherein:

said pivotally adjustable feature includes forming a pair of flattened sides on said mounting shaft and a spring biased braking member mounted in a block, said beater head connecting with said block, pressing of said braking member against one flattened side of said flattened sides will result in fixing said beater head in position.

14. A quick interchangeable and adjustable bass drum beater assembly as defined in claim 12 wherein:

said pivotally adjustable feature includes forming a pair of flattened sides on said mounting shaft and a spring biased braking member mounted in a block, said beater head connecting with said block, pressing of said braking member against a flattened side of said flattened sides will result in fixing of said beater head in position.

15. A quick interchangeable and adjustable bass drum beater assembly comprising:

a foot pedal mounted on a fixed base;

a connector mounted on said fixed base and located spaced from said foot pedal;

a connecting member connecting said connector to said foot pedal;

a bass drum beater which includes a shaft;

mounting said shaft to said connector, said shaft being pivotally and axially adjustable relative to said connector; and a locking mechanism mounted on said connector, said locking mechanism for fixing said shaft to said connector once a desired pivotal position and axial position for said beater has been obtained.

* * * * *